United States Patent [19]

Oestreich, Jr. et al.

[11] Patent Number: 4,809,851

[45] Date of Patent: Mar. 7, 1989

[54] COLLAPSIBLE CONTAINER

[75] Inventors: Gerald F. Oestreich, Jr., Burnsville, Minn.; William F. Price, Portage, Wis.

[73] Assignee: World Container Corporation, Burnsville, Minn.

[21] Appl. No.: 34,027

[22] Filed: Apr. 3, 1987

[51] Int. Cl.[4] ..... B65D 27/00

[52] U.S. Cl. ..... 206/599; 206/600; 206/511; 220/4 F

[58] Field of Search ..... 206/600, 503, 508, 571, 206/599; 220/4 T

[56] References Cited

U.S. PATENT DOCUMENTS

| | | | |
|---|---|---|---|
| 1,114,321 | 10/1914 | Warne . | |
| 1,355,213 | 10/1920 | Chipperfield . | |
| 1,991,965 | 2/1935 | Steinbreder . | |
| 2,202,675 | 5/1940 | Sherts . | |
| 2,952,379 | 9/1960 | Potter | 206/600 |
| 2,978,136 | 4/1961 | Ehrenfreund . | |
| 3,288,319 | 11/1966 | Cahill . | |
| 3,315,800 | 4/1967 | Wagner | 206/600 |
| 3,332,319 | 7/1967 | Gerry . | |
| 3,374,915 | 3/1968 | Verhein et al. . | |
| 3,386,218 | 6/1968 | Scott . | |
| 3,397,496 | 8/1968 | Sohns . | |
| 3,655,087 | 4/1972 | Luisada . | |
| 3,797,691 | 3/1974 | Williams, Jr. | 206/600 |
| 3,853,238 | 12/1974 | Luisada et al. . | |
| 3,940,007 | 2/1976 | Griffiths . | |
| 3,974,616 | 8/1976 | Beckley . | |
| 4,000,827 | 1/1977 | Emery . | |
| 4,050,604 | 9/1977 | Flanders | 206/600 |
| 4,120,551 | 10/1978 | Godtschalck . | |
| 4,171,059 | 10/1979 | Heller et al. | 206/600 |
| 4,376,593 | 3/1983 | Schaefer . | |
| 4,503,973 | 3/1985 | Andersson | 206/600 |
| 4,643,314 | 2/1987 | Kidd | 206/600 |
| 4,673,087 | 6/1987 | Webb | 206/600 |

*Primary Examiner*—Joseph Man-Fu Moy

*Attorney, Agent, or Firm*—Harold D. Jastram

[57] ABSTRACT

A collapsible container having a rigid construction including a base and upstanding sides which can be disassembled and stacked upon the base for storage. The base is provided with a generally flat supporting surface with a plurality of legs with mortises arranged to extend downward from the planar base support surface to receive and lock tenons attached to upstanding sides. The plurality of legs are spaced about the periphery of the base so that a container in either an assembled or collapsed position may be easily supported by a forklift or other such material-handling unit. Upstanding sides with tenons inserted into mortise elements of the unit are held in substantially erect position with the edges of the upstanding sides having tongue and groove connectors. Two of the sides are provided with grooves at the edges with the other two sides providing tongue elements at the edges and receivable into the grooves to provide a rigid and positive corner construction. Locking corner caps are attached to the upper edge of one of the sides of either the tongue or groove side. The locking L-shaped corner caps engages the upper edge of two corner sections of the adjacent side and lock the two sides together. The corner caps further includes a flange to engage legs of another container for vertical stacking. The upstanding sides of the container are vertically ribbed and may be re-enforced to increase the columnar strength of the unit.

16 Claims, 4 Drawing Sheets

COLLAPSIBLE CONTAINER

BACKGROUND OF THE INVENTION

Modern mass production of goods requires effective methods of supplying components to a manufacturing plant on a timely and efficient basis. These same manufacturing processes and procedures also generate a large quantity of refuse and industrial waste which also need to be removed from the manufacturing site to proper waste disposal locations or to recycling plants. These component supply needs and waste removal needs create a need for effective means for timely and constant delivery to manufacturing sites of a variety of industrial components and products. Without the timely arrival and a continuous supply of such components, mass production of finished goods rapidly encounters troublesome and inefficient production delays.

Further, mass production techniques generate a wide variety of waste components, some of which need to be disposed of in waste disposal locations. Other kinds of waste components can be recycled. Examples of recycleable waste components might include plastic containers used for encapsulating or transporting fragile electronics components which are used in manufacture or larger electrical units. The plastic containers or carriers for these components are essentially waste products which in many cases can be reprocessed for additional or continuous use. Accumulation of these waste components create a problem for the manufacturer and requires special handling of the components and timely and continuous removal from the manufacturing site in order to avoid unmanageable build-up of waste at the manufacturing site.

Methods for supplying components to manufacturing plants and for removing both finished goods and waste products from the manufacturing plant have been solved in a variety of ways. In some cases entire railroad cars or trucks are parked at the manufacturing site for the purpose of acting as temporary storage for components. These railroad cars and tractor trailors are extremely expensive components to have idly parked at such manufacturing plants during the course of utilizing the components. The extreme cost competitiveness involved in mass production prohibits the use of expensive containers of this type. Such transportation trailers and cars are also prohibitively expensive for collecting finished product or waste product for the same reason.

Other methods of delivering components to manufacturing plants and for removing finished goods and waste products involve some form of container which can be delivered to the manufacturing plant and is essentially a single-use container. Examples of these single-use containers might include containers made of various types of compressed paper. Other such containers include reinforced paper containers or wooden crates. Combinations of wood and paper-type fabric also are frequently used for transporting components for manufacturing processes. Most of these wood or paper containers are destroyed or unusable for repeated use and accordingly are the source of manufacturing waste products.

Many of the paper and wood containers are sufficiently large and laden with materials which are sufficiently heavy so that they present handling problems at the plant. These handling problems at the plant have typically been solved by the use of wooden pallets. Wood and fabric containers or other rigid containers containing heavy materials are frequently stacked on wooden pallets which have been constructed so that a forklift may be used to engage the pallet and lift the pallet and container filled with components to a location where further disposition may be made of the contents of the container.

Again, these wooden containers and the pallets themselves also become excess materials and are frequently damaged in the process of handling the heavy containers. The pallets are made form inexpensive wood with the view that the pallets will be damaged beyond use after a limited number of usages. Nevertheless, these pallets become additional waste material for a manufacturer.

Large containers which have been successfully used in manufacturing processes and in waste disposal procedures and which are intended for repeated use are frequently extremely large containers of sturdy construction. Many waste disposal containers, as an example, are made from thick rolled steel plates which permit rough handling of the container without destruction of the container. Many of these containers are as high as six feet tall and as large as six feet square or larger. Frequently, these sturdy large containers are also the same containers or similar to containers used for shipping components to manufacturers for use.

Typical uses of these large containers might be involved in the supply to a electrical units manufacturer where large numbers of transistors, resistors, capacitors and other small parts are used by the manufacturer to assemble radios, televisions and similar electronic components. Resistors, as an example, might be shipped to the manufacturer in bulk in such containers and deposited at the manufacturers warehouse for use in the manufacturing process.

The automobile industry also has a high demand for supplies of nuts, bolts, washers and similar connecting devices. Frequently these connectors are purchased in bulk from suppliers of such units. The bulk supplies are shipped from the manufacturer to the auto producer in containers which are deposited at the manufacturing warehouse or at the input line of the auto assembler.

Other industries also use bulk supplies of products. An example in the plastics industry might include plastic pellets which are supplied to a plastics molding manufacturer. Plastic pellets having the physical characteristics required by the manufacturer of plastic parts are supplied in bulk in large containers from which the raw plastic pellets are removed and further processed in the manufacturing process.

Likewise, bulk delivery of food products or components for food products such as flour, seasonings and similar food ingredients frequently need to be delivered to processors of packaged food products for mixing with a variety of components to produce packaged or finished food products.

As product is removed from the bulk containers by the manufacturer, the containers either become waste product themselves or if they are of the sturdy steel-plate construction or similar construction, they become empty units which must be stored until reuse. Whether the result of the manufacturing process is generation of a large volume of waste product from the containers themselves or the presence at the manufacturing site of a large volume of empty containers, there nevertheless is created for the manufacturer a handling problem and cost and also a storage cost. The waste product must be stored until removed from the site. Likewise, any reusable containers must be handled and stored until the container can be reused. These handling costs and storage costs all add incremental costs to the cost of manufacturing the end product and therefore removal of these cost components from the cost of manufacturing is very desirable on the part of manufacturers.

Additional problems encountered by goods transportation industries might be illustrated by the movement of household and industrial goods by transportation companies. Frequently, household goods or business goods might be packed in containers for loading on larger trucks. These containers are essentially one-way shipping units which must then be transported in an empty condition back to another site for filling with additional household goods. It is important to such transportation companies that the trucks hauling empty containers haul as many such containers as possible. Therefore, an effective and efficient collapsible container will permit such transportation companies to effectively and efficiently haul large numbers of these collapsible type containers to sites where they can be assembled for reuse. Likewise, storage of containers awaiting use can present costly warehousing if the containers cannot be collapsed to as small a unit as possible.

There is substantial incentive for providing a container which avoids many of these problems.

SUMMARY OF THE INVENTION

An object of the present invention is to provide a collapsible container having interlocking sides to establish a generally rectangular upstanding unit which includes a plane or base having a plurality of legs arranged to support the unit.

A further object of the present invention is to provide a container formed of joinable and separable sections including four sides, two of which are provided with vertical tongue elements at two edges and two of which are provided with groove elements which form a tongue and groove connection at the edges of the unit.

Another object of the invention is to provide a knockdown container having four releasable and joinable sides formed with a plurality of vertically oriented strengthening columns to provide columnar strength to the unit to permit stacking of multiple like containers.

It is still a further object of the present invention to provide a knock down container for storage and transportation of various bulk materials which includes a base having a plurality of peripherally spaced legs with the spacing selected to permit forks of a fork lift truck or other material handling vehicle to be inserted beneath the base and between the legs for lifting the container and load.

A further object of the present invention is to provide a collapsible container which includes individual sides connectable along the respective edges to form a generally rectangular container with selected sides being provided with corner locking elements that lock the individual sides together.

Another object of the present invention is to provide a collapsible container employing mortise joints for the purpose of connecting sides of a container to a base unit where the sides are locked together at the joining corners by a corner cap which functions as a corner support and as a multiple stacking support and restraining unit.

Another object of the present invention is to provide a collapsible container for the storage or transportation of various materials which includes four side elements, each of which is connectable through the use of a mortise joint to a base unit and in which the mortise joint is formed as part of legs supporting the container and positioned to permit a lift fork vehicle to lift the container fully loaded for ware housing or positioning at a manufacturing line assembly.

These and other objects and advantages of the invention will more fully appear from a consideration of the accompanying drawings and disclosure.

DESCRIPTION OF PREFERRED EMBODIMENT

Figure 1:
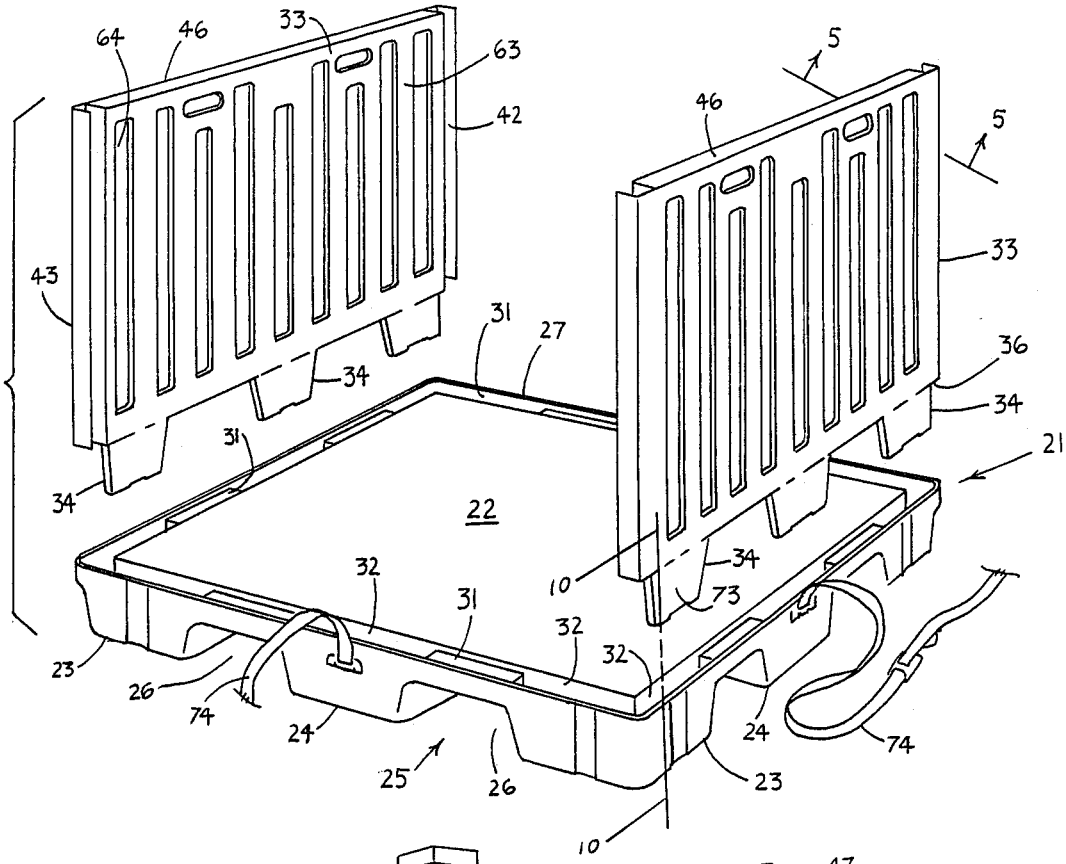
FIG. 1 is an exploded perspective view of two sides and a base of the container.
Figure 2:
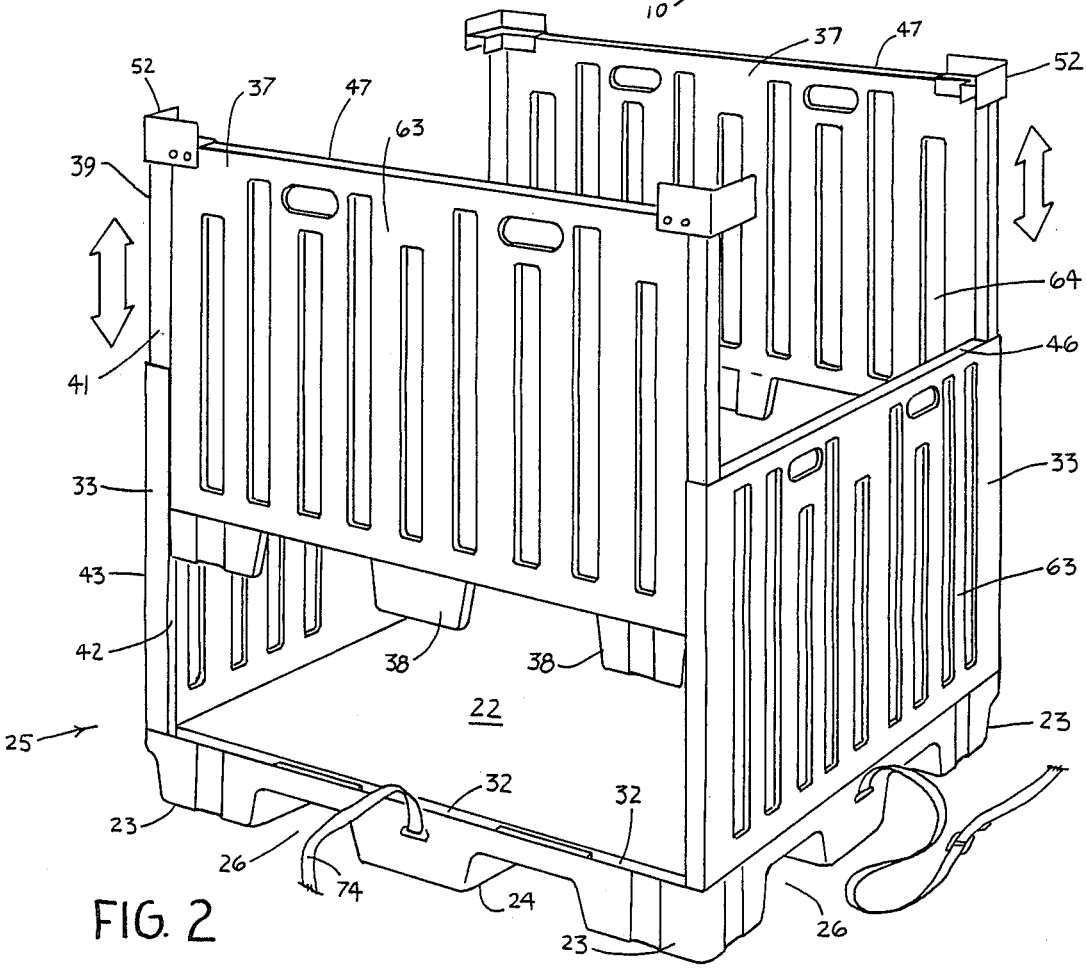
FIG. 2 is a partially exploded perspective view of a container according to the present invention showing four sides in the process of assembly on a base.
Figure 3:
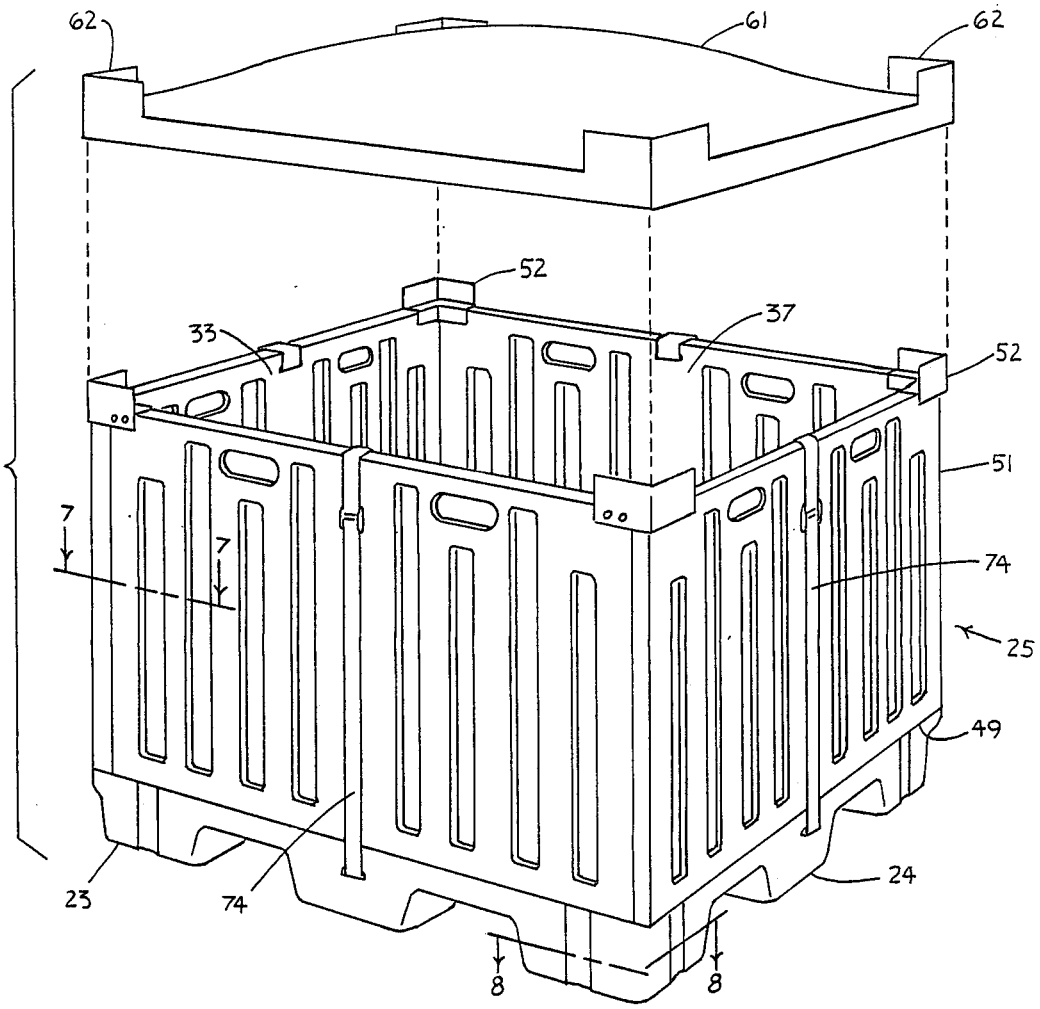
FIG. 3 is a perspective view of a collapsible container according to the present invention illustrating the container fully assembled.

Refer first to FIGS. 1, 2 and 3 of the drawings. FIGS. 1, 2 and 3 of the drawings depict a collapsible container generally designated by numeral 25 according to the present invention in the various stages of assembly from beginning in FIG. 1 of the drawings through completion in FIG. 3 of the drawings. The container made according to the present invention can be of a variety of sizes; however, the unique features of the invention permit the container finally assembled according to the present invention to be a relatively large container. For instance, the container can easily be eight feet square and five feet high or larger when finally assembled. Consequently, the sides of the container are quite large but nevertheless can be assembled by a single person due to the mortise joint features adopted in the construction of the container 25. The mortise joints are utilized in the assembly of the side of the container 25 to the rectangular base 21 of the container.

The base 21 of the container 25 includes a planar support surface or platform 22 which is supported at each corner by corner legs 23. Middle legs 24 are positioned intermediate the corner legs 23 along the edge 27 of the support platform 22. Middle legs 24 are positioned at a prescribed distance from corner legs 23 so that a lift channel 26 is formed on either side of each of the middle legs 24 around the entire periphery of the base 21. These lift channels 26 are designed to accommodate a standard fork lift of the kind that are commonly used in warehouses to lift pallets loaded with heavy containers of materials. With channels 26 positioned about the periphery of base 21, a fork lift can approach the base 21 from any of its four sides, insert the forks into channels 26 and lift the base 21 and consequently the entire container for stacking or removal to some other area.

Figure 13:
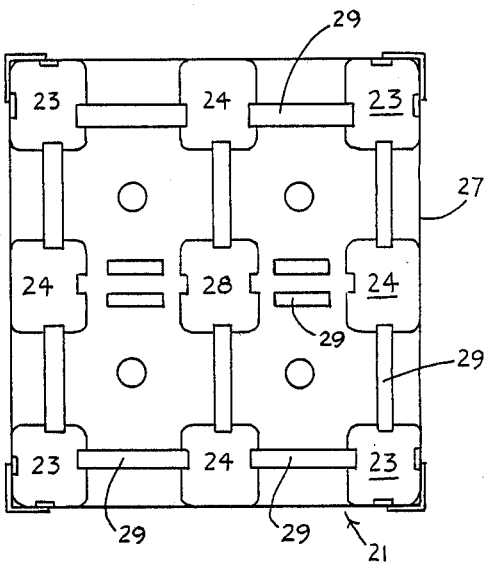
FIG. 13 is a plan view of a base of a container illustrating legs for supporting the container.

Support platform 22 is supported in the center by a center leg which can be more clearly observed in FIG. 13 of the drawings. It is noted in FIG. 13 that the center leg 28 is positioned in the center of support platform 22 in order to give the platform 22 added strength when the container 25 is filled with heavy materials such as steel bolts, washers or the like. Center leg 28 is positioned in the center of platform 22 so that a fork lift can be accommodated by lift channels 26 in any direction from the edge 27 of the support platform 22. Platform 22 also is given additional support under the stress of heavy loads by the use of ribs 29 which might simply be a bar of added material of which the platform 22 is made or ribs 29 might be steel reinforcing rods added to the bottom surface of support platform 22 and extending between center leg 28, middle legs 24 and corner legs 23 as depicted in FIG. 13 of the drawings. All of the legs 23, 24 and 28 are perpendicular to the platform or surface 22.

Figure 10:
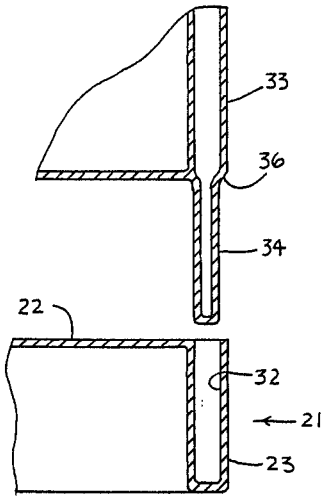
FIG. 10 is a fractional view in cross section illustrating a mortise joint connection.

At the edge 27 of base 21, an edge channel is provided along the entire outside edge 27 of support platform 22. A mortise is located in each of the middle legs 24 and two mortises are located in each of the corner legs 23. Sides 33 each have tenons 34 located along a lower edge 36 of side 33. The tenons 34 are shaped to engage the corresponding mortise in legs 23 and 24 to form a mortise joint between side 33 and base 21. A more detailed view of the mortise 32 and the tenon 34 is illustrated in FIG. 10 of the drawings. In that drawing it is noted that tenon 34 is positioned precisely within mortise 32 to provide a sturdy and secure mortise joint between the base 21 and side 23. The mortises 32 are perpendicular to the surface 22 and extend into each of the corner legs 23 and middle legs 24.

Again refer to FIGS. 1 and 2 of the drawings. Even though side 33 and its mirror image on the other side of base 21 are relatively large, being several feet in each dimension, nevertheless, the tenons 34 are sufficiently long so that when the side 33 is positioned in channel 31 with the tenons 34 securely engaging mortises 32, the mortise joint will support side 33 in a free-standing position perpendicular to support surface 22. Because the mortise joint permits side 33 to stand vertical and freely without support, this permits an assembler of the container to position one side at a time without the assistance of a second assembler. During the assembly process, an assembler may then position a first side 33 and leave it standing unsupported except through the mechanical leverage of the mortise joint formed by tenons 34 and mortises 32 and then assemble the other side 33 which is the mirror image opposite the first side 33 on the opposite side of base 21. The tenons 34 and mortises 32 on either side of the base 21 are identical so that sides 33 are interchangeable.

FIG. 2 of the drawings illustrates the next step in the assembly of a container according to the present invention. After sides 33 have been firmly positioned in an upright position perpendicular to the plane of the support platform 22, a side 37 is positioned for engagement with sides 33 and also for engagement with mortises 32 along edge 27 of base 21. Side 37 also is constructed with a series of tenons 38 which are designed to precisely fit mortises 32 located in corner legs 23 and center legs 24. Tenons 38 work exactly the same as tenons 34 and consequently the description of the function of tenons 38 is the same as that used in connection with tenons 34 as viewed in FIG. 10 of the drawings. Tenons 38 are designed to precisely fit the mortises 32 so that side 37 is rigidly connected in a vertical position to base 21. As with sides 33, sides 37 could also be separately positioned in the base 21 through the use of a mortise joint and the individual sides 37 would be self-supporting.

Tenons 34 and 38 are tapered. The tapered shape can be observed in FIGS. 1, 2 and 3 of the drawings. Likewise, mortises 32 are also tapered the same as the tenons so that the tenons 34 and 38 precisely engage mortises 32 to form a tight, rigid connection.

Side 37 is designed to cooperate with side 33 along each edge of the sides in order to securely lock the edges of the respective sides together in a tongue and groove connection. Edge 39 of side 37 is a tongue element 41 which is designed to slide within channel 42 which extends along the length of edge 43 of side 33. Each of the sides 33 has a channel 42 extending the full length of the side 33 from the top 46 to the lower edge 36 of side 33. This channel is perpendicular to lower edge 36. Likewise, tongue 41 extends the full length of side 37 from top 47 to lower edge 48. Tongue 41 is also perpendicular to lower edge 48. There is an identical tongue 41 on each edge 39 of side 37 which is designed to engage channel 42 of opposing sides 33 of the container.

FIG. 2 of the drawings illustrates side 37 partly assembled with the tongue 41 partly engaged with the channel 42 of side 33. The container has two identical sides 37 which again are mirror images of each other just as sides 33 are mirror images. The respective mirror images of 37 each have tongues 41 on each edge of the side 37 for engaging adjacent channels 42 which extend along each edge of mirror image sides 33. Thus, when sides 37 engage sides 33 through the use of the tongue and groove channel, the sides 33 and 37 create a rigid construction.

The tongue and groove engagement described in connection with sides 33 and 37 are illustrated in greater detail in FIG. 9 of the drawings which depict a perspective view of the sides 33 and 37. The view shows the channel or groove 42 on each edge of side 33 which cooperates with tongue 41 and which makes up each edge of side 37 to form the tongue and groove assembly for fitting sides 33 and 37 together to form the sides of the container.

Side 37 is lowered onto base 21 so that the tongue and groove connection is fully engaged and so that the tenons 38 fully engage mortises 32 in the base 21. Thus assembled, the container appears as illustrated in FIG. 3 of the drawings. A mortise joint 49 is thus formed between sides 37 and 33 around the entire circumference of base 21. Since the mortise joint is sufficiently rigid and tight fitting to permit each of the sides 33 and 37 to stand alone, it will be apparent that locking of the sides 33 and 37 through the use of a tongue and groove assembly along each of the edges 51 will add great structural rigidity to the container. While the structural rigidity is achieved through the combination of tongue and groove edge fittings and a mortise joint between the sides 33 and 37 and the base 21, the container nevertheless is very rigid and will easily accommodate loads of heavy articles such as steel washers, articulate material, and even liquids under certain circumstances. For example, if the container 25 is lined with a liquid-proof liner such as plastic, the container 25 can be filled with a liquid and still maintain its rigidity and structural integrity.

Figure 11:
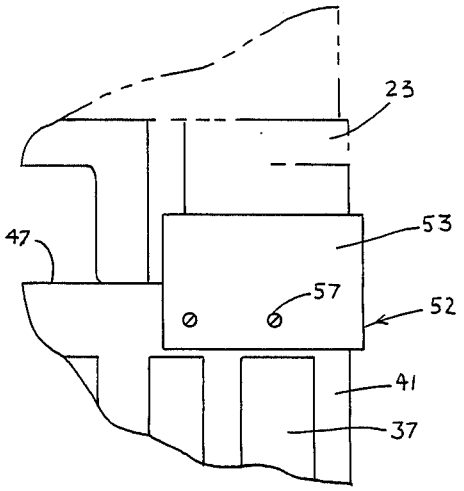
FIG. 11 is a fractional view illustrating a corner cap connecting the sides of a container.
Figure 12:
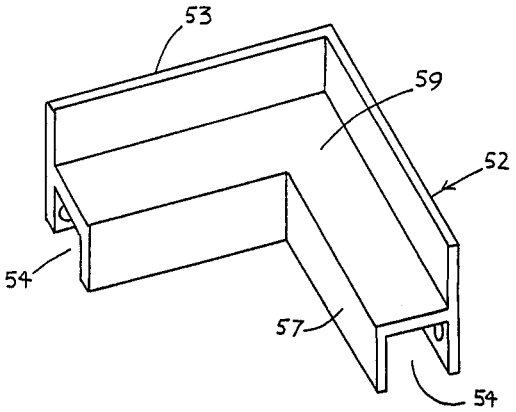
FIG. 12 is a perspective view of a corner cap according to the present invention.

The collapsible container 25 is specifically designed to accommodate heavy loads of bulky material and to act as a storage container. Further, the container 25 is, because of its physical size, capable of accommodating extremely heavy loads which exert tremendous pressure on sides 33 and 37. Accordingly, an added feature of the container 25 is to provide corner caps 52 which serve a multiple function. First the corner caps 52 are attached to one set of similar sides. In the example illustrated in FIGS. 2 and 3 of the drawings, the corner caps 52 have been attached at the corners of sides 37 and are overlapping the tongue 41 at the intersection of tongue 41 and top 47. A more detailed view of corner cap 52 is illustrated in FIG. 12 of the drawings. Corner cap 52 is a right angle or L-shaped brace which has an H cross-sectional shape as illustrated in FIG. 12. Corner cap 52 has a flange 53 having a function which will be more specifically described hereafter. The cap 52 has a channel 54 which is designed to fit over edge 47 of side 37. One leg of the L-shaped cap 52 is positioned over a corner of side 37 as illustrated in FIG. 11 of the drawings. This leg 56 is bolted to the side 37 by bolts 57 so that it remains rigidly in place and acts as a cap over the corner of side 37.

A cap 52 is placed over each corner of side 37 as illustrated in FIG. 2 of the drawings and in each case is bolted or rivited to the side 37. When side 37 as viewed in FIG. 2 of the drawings is lowered into position with tenons 38 engaging mortise 32, the second leg 58 engages the top edge 46 of the adjacent side 33 to lock the corners of sides 37 and 33 securely together. Thus, end cap 52 acts as a corner lock to rigidly connect the sides 33 and 37 together and to reinforce the corners of engagement between the sides. This locking engagement of corner cap 52 is best illustrated in FIG. 3 of the drawings where sides 33 and 37 are illustrated fully in place with end caps 52 engaging adjacent sides. Corner cap 52 may be made of any strong material such as steel, aluminum, or similar material. A primary objective of corner cap 52 is to add reinforcement across the corners of engagement between sides 37 and 33 and to provide additional strength at the top of the assembled container.

Corner caps 52 also serve an additional and important function in the invention. The flange 53 of corner caps 52 acts as a stabilizing unit so that additional containers identical to the container of this invention may be vertically stacked one on top of the other to produce a column of stacked containers for storage and warehousing of materials. Corner legs 23 of the container are designed so that they exactly fit within the four corner caps 52 and are securely fixed in place and prevented from moving horizontally by flange 53 of the corner cap 52. This cooperation between the flange 53 and leg 23 is best illustrated in FIG. 11 of the drawings where leg 23 is shown positioned on top of corner cap 52 and retained in place by flange 53. If the containers, according to this invention, are to be stacked, a fork lift truck can merely insert the lift forks into channels 26 of a second container and position the second container over top of the first container. The second container is then lowered onto the first container positioning the corner legs 23 within the corner caps 52 and lowering the second container onto corner cap base 59. The container constructed according to this invention is sufficiently strong to withstand the weight of multiple containers bearing weight of other containers loaded with material.

Another important feature of the present invention is the flexibility built into this container to function in a variety of ways. Reference to FIG. 3 of the drawings will reveal that corner caps 52 also act as stays for holding a cover 61 in place on the container if the goods carried by the container are to be shielded from rain, moisture or other contamination. In this function, a cover 61 is molded in a shape which provide corner covers or members 62 which can be inserted over corner caps 52 to hold cover 61 in place. Corner covers 62 serve not only to secure cover 61 to the container, but also function the same as corner caps 52 and act as restraining members in the event that containers, all of which contain lids are stacked. Corner covers 62 are hollow, L-shaped extensions that fit over L-shaped corner caps 52. After cover 61 is securely positioned over the container, with corner covers 62 in place over corner caps 52, then a second container may be lifted and positioned into place and vertically stacked upon the covered container. The L-shaped corner covers 62 now function exactly as corner cap 52 functioned and as earlier described to receive corner legs 23 of the container stacked immediately above and thus function the same as corner caps 52. Corner caps 52 provides a very important and multifunctional purpose in this container. Caps 52 lock the corners of sides 37 and 33 together, act as a stacking mechanism and act as means for securely holding a cover on top of the container 25.

The container according to this invention can be used for a wide variety of storage purposes. Some of these storage and transportation purposes involve very heavy materials which may require reinforcement of the sides of the container. Reinforcement of this container can be accomplished very easily by adding reinforcing rods in the side walls of 33 and 37 of the container. The side walls 33 and 37 are already formed in a waffle pattern formed by hollow ribs 63. These ribs can be observed readily in several of the drawings. The support platform 22, sides 33 and 37 and the top 61 of the container are preferably made from special compositions of plastic, fiberglass, or similar materials which can be laminated, molded or injection molded to form the sides having the complex shapes illustrated in the drawings and forming ribs 63 to reinforce the sides and give the container 25 columnar strength, vertical to and lateral to the support surface 22. One illustration of the cross sectional shape of the sides 33 and 37 is illustrated in FIG. 37 of the drawings where the ribs 63 are observed to be hollow with intermediate areas 64 joined to form a waffle construction which has proven to be structurally very strong. This construction may be achieved by joining sheets of moldable material at the intermediate areas 64 and joining several layers of material together at these points either by gluing, heat welding or by other well-known means, depending upon the composition of the material used to construct the container. As an example, if a thermal plastic is used, then heat at carefully controlled temperatures may be used to join the various layers of material in order to form the strong laminated waffled pattern depicted in the drawings.

Figure 5:
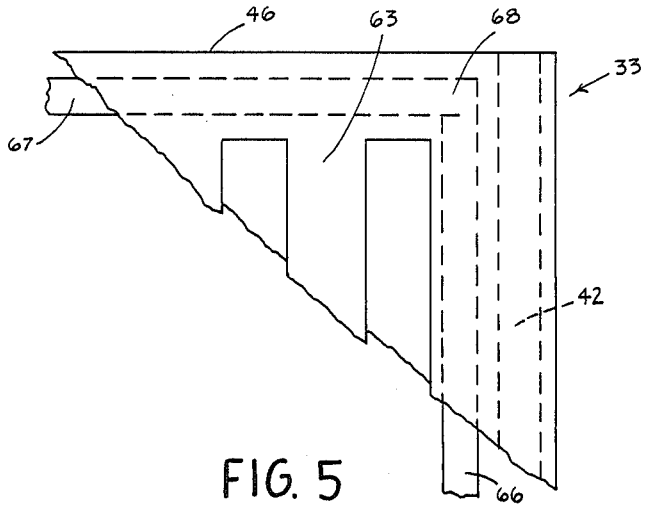
FIG. 5 is a partial view taken along line 5—5 of FIG. 1 illustrating a corner of a side.
Figure 6:
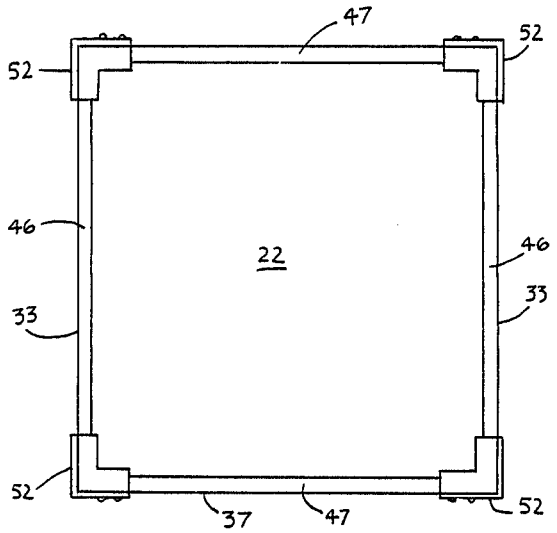
FIG. 6 is a planned view of the container assembled according to the present invention.
Figure 7:
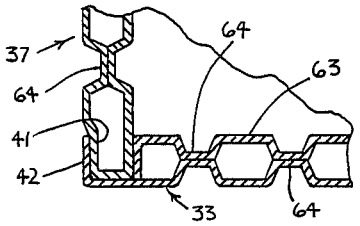
FIG. 7 is a fractional cross sectional view showing a corner connection between two sides of a container.

Further reinforcement of the sides 33 and 37 may be necessary in order to increase the lateral resistance to loads in the container and also to add vertical or columnar strength in the event the containers are to be stacked. In the case where the sides 33 and 37 are molded, steel reinforcing rods or similar rods 66 may be molded into the sides 37 and 33 as the sides are being manufactured. Illustrations of such rods may be observed in FIGS. 5 and 9 of the drawings in which a vertical reinforcing rod 66 is molded or laminated into a rib 63 at the time of manufacturing. This vertical rod 66 which is perpendicular to the surface 22 adds columnar strength to the container and extends the length of the side from near the top edge 46 to a position near the lower edge 36 of side 33 as an example. Rod 66 provides vertical strength to the container so that some of the weight positioned at the corners of the container over corner cap 52 will be transferred along the length of reinforcing rod 66 and provide added strength for stacking the containers.

Further strength in a horizontal direction may be added to the side 33 and also side 37 by adding another horizontal reinforcing rod 67 horizontally along the top edge 46 of side 33. It should be specifically noted at this point that a horizontal reinforcing rod 67 may also be positioned in exactly the same location of side 37 near top edge 47. The function of these rods however is being described in connection with side 33 taken along line 55 of FIG. 1 of the drawings and specifically illustrated in FIG. 5. Horizontal reinforcing rod 67 adds additional horizontal strength to the side 33 in the event weight is placed at the center of edge 46 due to stacking or other functions of the container.

Reinforcing rods 66 and 67 can be placed in both sides 33 and 37 and function exactly the same in each side. The above-identified description in connection with side 33 is for illustrative purposes only. Horizontal reinforcing rod 67 as noted in FIG. 5 of the drawings can be joined at a corner 68 with a vertical reinforcing rod 66 to add further structural rigidity to the side 33. As many vertical rods 66 as desired may be added to the side 33 and the number is only limited by the number of ribs 63 the side may contain. Further, the manner of adding rods 66 and 67 to the sides 33 will be governed to some extent by the manner and material used to form side 33. For instance, if the side 33 is made in a laminating process, then the vertical rod 66 and horizontal rod 67 may be positioned between the two laminating sheets during the formation of the sides 33. The rods may also be placed in the sides in an injection molding process where thermal plastics or similar materials are used to form sides 33.

Figure 9:
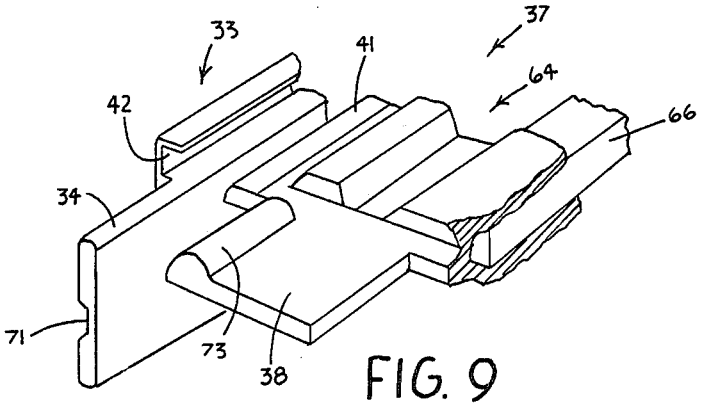
FIG. 9 is a perspective fractional view showing an edge connection between adjacent sides of the container.

The rod 66 extends the length of side 33 and can be positioned as illustrated in FIG. 9 of the drawings against a bottom ridge 69 thus transferring any load along rod 66 to the ridge 69.

Figure 8:
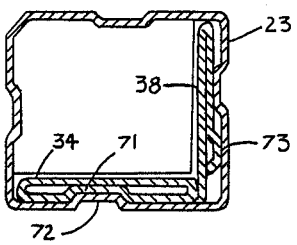
FIG. 8 is a cross sectional view taken along line 8—8 of FIG. 3 of the drawings showing a tenon and mortise connection in a leg of the base.

Refer now to FIG. 8 of the drawings which illustrates a cross section of tenons 34 and 38 of sides 33 and 37 respectively. A tenon rib 71 is formed in tenon 34 and is designed to exactly fit leg rib 72 so that when tenon 34 is inserted into the mortise 32, the tenon 34 will precisely and securely be fitted and held within the mortise.

The ribs 71 and 72 add additional lateral stability to the tenon and mortise connection and also serve as a method for identifying which side is positioned. Tenon 38 contains a projection 73 which is different from the leg rib 71 so that it will not function as smoothly if an attempt is made to mount side 37 on the wrong side of base 21. Projection 73 indicates to an assembler that the side needs to be positioned on a different side of the container 25. This feature involving ribs 71 and projection 73 would be important if the container is not precisely square but is more rectangular in shape. The rib 71 and projection 73 will immediately indicate to a party constructing the container to reposition the particular side on a different side of the base 21.

Figure 4:
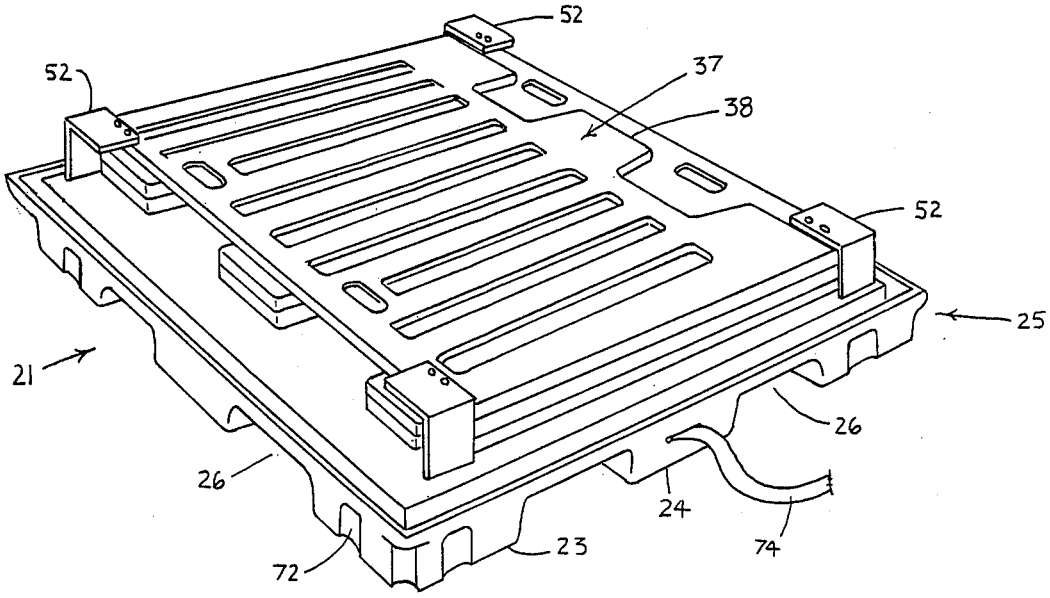
FIG. 4 of the drawings is a perspective view of the container according to the present invention in the collapsed position with sides nested on a base.

Refer next to FIG. 4 of the drawings which demonstrates one of the outstanding features of the present invention. The container, according to the invention is illustrated in FIG. 4 in a collapsed and nested position. The sides 33 and 37 of the container are specifically designed to nest one on top of the other which in turn are positioned on top of base 21 in order to provide a compact package for storage and transportation purposes. Sides 37, which contain corner caps 52 are designed to nest with each other as illustrated in FIG. 4 so that the caps 52 of each of the sides 37 are 180 degrees apart from each other as positioned together. Sides 37 are then positioned over sides 33 to cover the sides 33 which are lying on support platform 22 of base 21. This entire assembly then is compactly nested and can be secured by straps 74 to secure the bundle together.

The container 25 notably makes no use of bolts, hinges or clasps either as assembled or disassembled for the purpose of constructing a structurally strong container or for the purpose of compactly collapsing the containers.

The above illustrated and described preferred embodyment of the invention may be altered in a variety of ways and still remain within the spirit and scope of the embodyments. As previously noted, the materials from which the container can be constructed can vary from wood to metal to a variety of plastics. In the case of plastics, the plastics, may be formed by injection molding, lamination of plastic sheets or similar processes. Further, straps 74 designed for securing the collapsed container can also be used as illustrated in FIG. 3 of the drawings to secure the sides 33 and 37 to the base 21 for additional rigidity in the container. These straps 74 are not absolutely necessary, however, if certain applications require further vertical tension to be applied to the sides 33 or 37 then staps 74 are a method by which this can be accomplished. Strap 74 interconnect base 21 with sides 33 and 37 to hold the sides into together with the cooperation of the mortise joint 49.

Corner caps 52 can take somewhat different shapes and be constructed of different kinds of material. The important features are as illustrated, namely acting as a stacking mechanism, reinforcing the corners of the adjoining sides 33 and 37 and acting as a method for securing the lid 61 to the container. These end caps 52 may be mounted in pairs either on sides 33 or 37 since the location is merely a matter of design choice. The container may be square or rectangular at the option of the manufacturer in order to accommodate a variety of warehousing and transportation needs.

Ribs 71 and 72, as well as projection 73 may be used at the option of the manufacturer of the containers. The ribs as indicated add an additional feature to the mortise joint formed by the tenons and mortise of this container. The number of vertical reinforcing rods 66 placed in the sides 33 and 37 may be varied according to the strength needs and the use of the container. Addition of such reinforcing rods adds additional cost to constructing the container and additional weight to the container. Where cost and weight considerations are more important than structural strength, then these reinforcing rods 66 and 67 can be entirely eliminated from the construction of the container. These and other changes may be made to the invention without departing from the spirit and scope which are set forth in the following claims.

What is claimed is:

1. A collapsible container for transporting and storage of materials and parts which comprises:

A. A rectangular base having a generally planar support surface;

B. A plurality of legs mounted about the periphery of said support surface and extending from said surface downwardly and perpendicular to said support surface;

C. Said legs having mortises extending into said legs and from the periphery of said support surface and perpendicular to said support surface;

D. A first pair of sides having tenons extending from a bottom edge of each of said first pair of sides and for engaging the mortises in said legs to form a mortise joint to position each of said pairs of first sides in an upright position perpendicular to said support surface on opposite sides of said base;

E. A second pair of sides having tenons extending from a bottom edge of each of said second pairs of sides and for engaging the mortises in said legs to form a mortise joint to position each of said pairs of second side in an upright position perpendicular to said support surface on opposite sides of said base and in edge to edge contact with said first sides; and, F. Means for connecting said first and second sides in the rectangular configuration of said base.

2. A container in accordance with claim 1 in which said legs are positioned about the periphery of said base to provide openings between the legs to accommodate a fork lift to lift the container.

3. A container in accordance with claim 1 in which said first and second sides each have vertically disposed, hollow ribs spaced laterally and extending perpendicular to said support surface to provide rigidity to such sides and to increase the columnar strength of such sides.

4. A container in accordance with claim 1 in which said first pair of sides has a groove extending along the entire length of each edge of said first sides which are perpendicular to the bottom edge of said first side and in which said second pair of sides has a tongue member extending along the entire length of each edge of said second sides which are perpendicular to the bottom edge of said second sides, said tongue members of said second sides engaging adjacent grooves of said first side to form tongue and groove edge connection between said first and second pairs of sides.

5. A container in accordance with claim 1 which further includes a center leg mounted in the center of said base and extending downwardly from said base to provide support for said support surface and in which said center leg is positioned with respect to said plurality of legs to accommodate lifting of said base by a fork lift.

6. A container in accordance with claim 1 in which said means for connecting includes corner caps interconnecting said first and second sides where such sides make edge-to-edge contact.

7. A container in accordance with claim 1 in which said legs have ribs extending along one side of said mortises and in which said tenons have ribs for engaging the ribs in said mortises.

8. A container in accordance with claim 1 which further includes reinforcing ribs mounted in said planar support surface and extending between said legs to strengthen said planar support surface.

9. A container in accordance with claim 1 which further includes a tension member connected to each side of said rectangular base and for connection to an individual side of each of said first and second pairs of sides to secure each of said first and second sides to said base.

10. A container in accordance with claim 1 in which each mortise and tenon is tapered to insure locking engagement between the tenon and the mortise and to ease removal of each tenon from the engaged mortise.

11. A container in accordance with claim 3 which further includes reinforcing rods mounted in selected of said hollow ribs to increase the columnar strength of said first and second pairs of sides.

12. A container in accordance with claim 3 which further includes reinforcing rods mounted perpendicular to said hollow ribs in each of said pairs of first and second sides and along a top edge of each of such sides opposite said bottom edge.

13. A container in accordance with claim 6 in which said corner caps are generally L-shaped and permanently attached to said first pair of sides and removably engage said second sides and in which said corner caps have a flange for engaging a container unit positioned above said container for stacking.

14. A container in accordance with claim 13 which further includes a top for covering said container and in which said top has corner members for engaging said flanges of said corner caps to secure said top to said container.

15. A container in accordance with claim 14 in which said corner members are L-shaped and include a hollow extension for engaging said flange and for restraining a container unit positioned above said cover for stacking.

16. A collapsible container for transporting and storage of materials and parts which comprises:

A. A rectangular base having a generally planar support surface with an outside edge about the entire periphery of said support surface;

B. said outside edge forming a channel along said periphery;

C. A plurality of legs mounted about the periphery of said support surface and extending from said channel downwardly and perpendicular to said support surface;

D. Said legs having mortises extending from said channel in the periphery of said support surface and extending into said legs perpendicular to said support surface;

E. A first pair of sides having tenons extending from a bottom edge of each of said first pair of sides and for engaging the mortises in said legs to form a mortise joint to position each of said pairs of first sides in an upright position perpendicular to said support surface on opposite sides of said base;

F. A second pair of sides having tenons extending from a bottom edge of each of said second pairs of sides and for engaging the mortises in said legs to form a mortise joint to position each of said pairs of second side in an upright position perpendicular to said support surface on opposite sides of said base and in edge to edge contact with said first sides;

G. The bottom edge of said first and second pairs of sides engaging said channels; and H. Means for connecting said first and second sides in the rectangular configuration of said base.

* * * * *